United States Patent [19]

Hiebert, deceased et al.

[11] 4,365,937

[45] Dec. 28, 1982

[54] ADJUSTABLE PITCH PROPELLER DRIVE

[76] Inventors: Harold L. Hiebert, deceased, late of Port Townsend, Wash.; by Shirley M. Hoff, executrix, 31009 44th Ave. South, Federal Way, Wash. 98003

[21] Appl. No.: 256,582

[22] Filed: Apr. 22, 1981

Related U.S. Application Data

[63] Continuation-in-part of Ser. No. 97,491, Nov. 26, 1979, abandoned.

[51] Int. Cl.[3] ..... B63H 3/08

[52] U.S. Cl. ..... 416/157 R; 416/137; 416/205

[58] Field of Search ..... 416/137, 157 R, 157 B, 416/48, 205

[56] References Cited

U.S. PATENT DOCUMENTS

| | | | |
|---|---|---|---|
| 9,849 | 7/1853 | Brown | 416/166 |
| 188,106 | 3/1877 | De Beaumont | 416/166 |
| 700,278 | 5/1902 | Wilson | 416/166 |
| 1,072,249 | 9/1913 | Morley | 416/166 |
| 1,125,719 | 1/1915 | Ritchie | 416/166 |
| 1,380,057 | 5/1921 | Gove | 416/166 |
| 1,723,617 | 8/1929 | Hele-Shaw et al. | 416/48 |
| 1,777,254 | 9/1930 | Connors | 416/166 |
| 2,010,640 | 8/1935 | Michl | 416/166 |
| 2,255,920 | 9/1941 | Englesson | 416/157 R |
| 2,304,153 | 12/1942 | Cesare | 416/166 |
| 2,308,488 | 1/1943 | Caldwell et al. | 416/157 R |
| 2,355,039 | 8/1944 | Eves | 416/157 R |
| 2,501,720 | 3/1950 | Godden et al. | 416/157 R |
| 2,693,242 | 11/1954 | Strandell et al. | 416/157 R |
| 2,794,508 | 6/1957 | Pehrsson et al. | 416/157 R |
| 2,931,443 | 4/1960 | Pehrsson | 416/157 R |
| 3,051,249 | 8/1962 | Dirlik | 416/157 R |
| 3,056,457 | 10/1962 | MacFarland | 416/157 R |
| 3,171,494 | 3/1965 | Liaaen | 416/157 R |
| 3,216,507 | 11/1965 | Curioni | 416/157 R |
| 3,387,664 | 6/1968 | Cummings | 416/157 R |
| 3,600,102 | 8/1971 | Dirlik | 416/157 R |
| 3,792,937 | 2/1974 | Chilman | 416/157 R |
| 3,895,598 | 7/1975 | Blickle | 416/147 |
| 4,028,004 | 6/1977 | Wind | 416/157 R |
| 4,037,986 | 7/1977 | Chilman | 416/157 R |
| 4,141,673 | 2/1979 | McCormic | 416/170 R |
| 4,229,141 | 10/1980 | Mesado | 416/157 R |

FOREIGN PATENT DOCUMENTS

| | | | |
|---|---|---|---|
| 889402 | 9/1953 | Fed. Rep. of Germany | 416/166 |
| 1011820 | 7/1957 | Fed. Rep. of Germany | 416/157 R |
| 283406 | 1/1965 | Netherlands | 416/157 R |
| 821824 | 10/1959 | United Kingdom | 416/205 |
| 823526 | 11/1959 | United Kingdom | 416/205 |

*Primary Examiner*—Philip R. Coe
*Assistant Examiner*—Frankie L. Stinson
*Attorney, Agent, or Firm*—Delbert J. Barnard; Eugene O. Heberer; Joan H. Pauly

[57] ABSTRACT

A pair of axially movable abutments are spaced apart axially within a propeller hub. A plurality of adjustable propeller blades are rotatably mounted on the hub and each has an inner portion located inside the hub. Such inner portion is in the form of a pinion gear. Racks extend axially inwardly from each abutment and drivingly engage respective pinion gears on the blades. Compression spring or springs are positioned between the abutments and fluid pressure is used for applying an axially inward force on the abutments for moving both abutments axially inwardly toward each other in opposition to the force of the springs for the purpose of rotating the propeller blades in a first direction. The energy that is stored in the springs when compressed is used to rotate the propeller blades in the opposite direction when the fluid force is removed from the abutments.

In two of the embodiments a driving shaft is solid, and the fluid motor for moving the abutments together is within the hub and in another embodiment the driving shaft is hollow and the fluid motor is positioned forwardly of the hub, connected to the forward end of the drive shaft. In the latter embodiment, the springs, in two sets, can be employed in the fluid motor.

68 Claims, 8 Drawing Figures

Fig. 4.
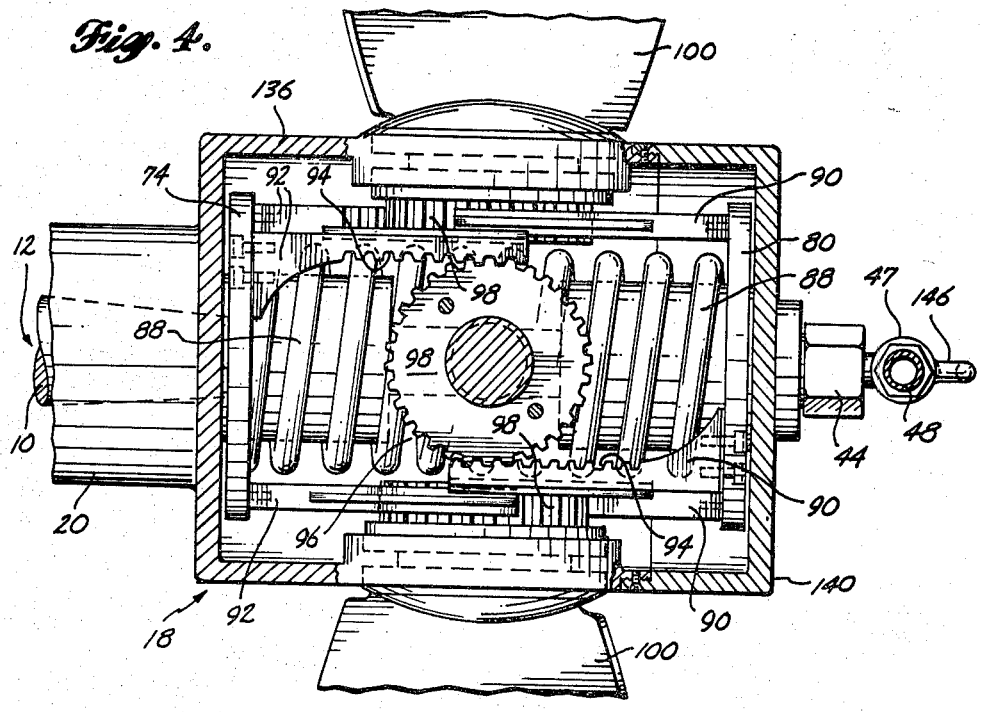
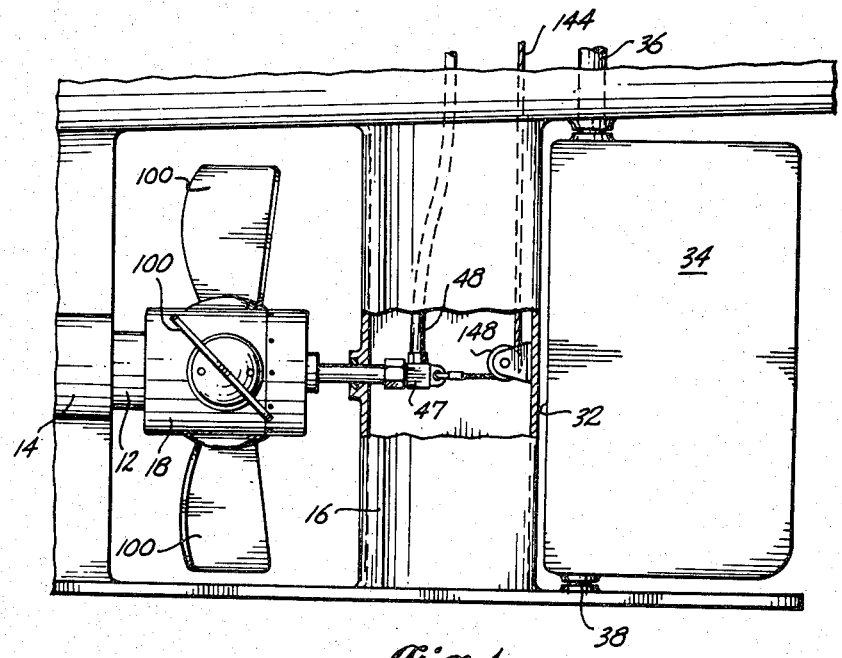
Fig. 1.

Fig. 5.
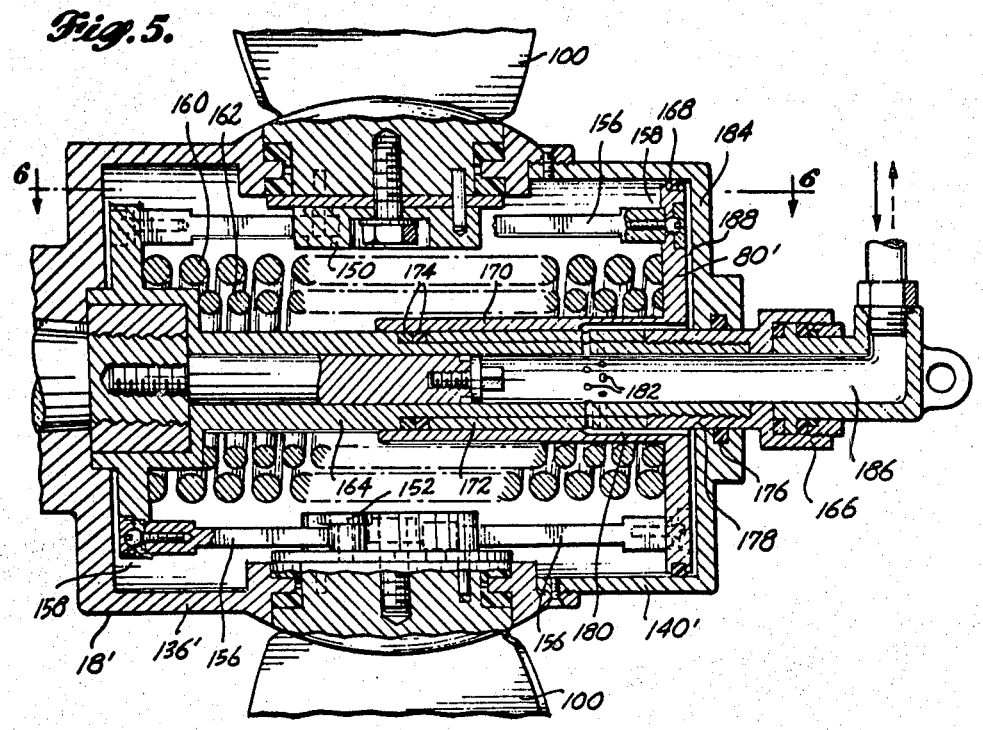
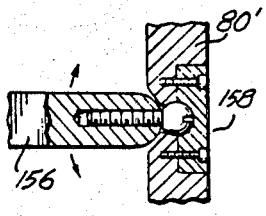
Fig. 7.
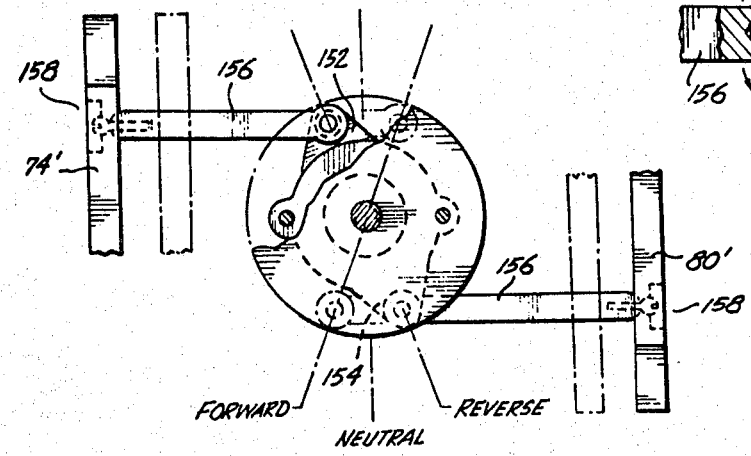
Fig. 6.

ADJUSTABLE PITCH PROPELLER DRIVE

DESCRIPTION

Cross Reference To Related Application

This application is a continuation-in-part of an application entitled Adjustable Pitch Propeller, Ser. No. 097,491, filed Nov. 26, 1979, and now abandoned.

TECHNICAL FIELD

This invention relates to an adjustable pitch propeller of a type which includes a mechanical drive for providing the force which rotates the propeller blades from a high pitch forward position to a high pitch reverse position, for example, and includes a compression spring to return the blades to the former position.

BACKGROUND ART

It has long been known that propeller blades for driving a vehicle through a fluid should have a low pitch for providing maximum force to the vehicle for acceleration. At high vehicle speeds, however, the blade pitch should be increased to reduce engine r.p.m. while maintaining vehicle speed. It is also known to adjust propeller blades for the purpose of slowing, stopping, or reversing the motion of the vehicle. Further, it is common practice to use some sort of mechanism for positively driving the blades from a high pitch forward position toward the second end position of the blades, e.g. a high pitch reverse position, and then return the blades to their high pitch forward position by means of energy stored in a compression spring.

In the known systems of this type, one end of the spring is held against a stationary abutment and the second end of the spring is moved to compress the spring as the propeller blades are rotated by a a positive drive mechanism. Each increment of blade rotation causes an increment of compression of the spring attended by a storage in the spring of an increment force dependent on the design and size of the spring.

It is also known that most variable pitch propellers for aircraft and marine vehicles are relatively complex and expensive.

Examples of variable pitch propeller mechanisms found in a search of the patent literature are disclosed in the following patents:

| | |
|---|---|
| British 821,824 | Chadwick |
| British 823,526 | Chadwick |
| U.S. Pat. No. 4,229,141 | Mesado |
| U.S. Pat. No. 1,723,617 | Hele-Shaw et al |
| U.S. Pat. No. 4,028,004 | Wind |
| U.S. Pat. No. 4,037,986 | Chilman |
| U.S. Pat. No. 3,792,937 | Chilman |
| U.S. Pat. No. 2,501,720 | Godden et al |
| U.S. Pat. No. 2,355,039 | Eves |
| U.S. Pat. No. 2,225,920 | Englesson |
| U.S. Pat. No. 2,693,243 | Strandell et al |
| U.S. Pat. No. 4,141,673 | McCormick |
| U.S. Pat. No. 3,171,494 | Liaaen |
| U.S. Pat. No. 9,843 | Brown |
| U.S. Pat. No. 188,106 | De Beaumont |
| U.S. Pat. No. 2,304,153 | Di Cesare |
| U.S. Pat. No. 700,278 | Wilson |
| Netherlands 283,406 | Lips |
| U.S. Pat. No. 1,072,249 | Morley |
| U.S. Pat. No. 1,125,719 | Ritchie |
| U.S. Pat. No. 1,380,059 | Gove |
| U.S. Pat. No. 1,777,254 | Connors |
| U.S. Pat. No. 2,010,640 | Michl |
| U.S. Pat. No. 2,308,488 | Caldwell et al |

-continued

| | |
|---|---|
| U.S. Pat. No. 3,051,249 | Dirlik |
| U.S. Pat. No. 3,216,507 | Curioni |
| U.S. Pat. No. 3,387,664 | Cummings |
| U.S. Pat. No. 3,895,598 | Blickle |
| West Germany 1,011,820 | Fischer |
| West Germany 889,402 | Bartalszky |
| U.S. 3,600,102 | Dirlik |
| U.S. Pat. No. 3,056,457 | MacFarland |
| U.S. Pat. No. 2,931,443 | Pehrsson |
| U.S. Pat. No. 2,794,508 | Pehrsson et al |

These patents and the prior art that is discussed and/or cited therein may be carefully studied for the purpose of putting the present invention into proper perspective relative to the prior art.

DISCLOSURE OF THE INVENTION

It is an object of the present invention to provide an adjustable pitch propeller of the type including a compression spring for driving the propeller blades toward a high pitch forward position, characterized by a construction which will result in a doubling of the force stored in the spring for each increment of propeller blade rotation.

In a preferred mode of the invention, a pair of axially movable abutments are spaced apart axially within a hub on which a plurality of adjustable pitch propeller blades are mounted. A compression spring means is positioned between the abutments with one end of the spring means bearing against one of the abutments and the other end of the spring means bearing against the other abutment. The spring means normally bias both of the abutments axially outwardly.

A mechanical drive means is interconnected between each abutment and an inner end portion of each blade extending into the hub. Each mechanical drive means functions to apply a pitch changing rotational force on its blade in response to an axial movement of its abutment. The system includes means for applying an axially inward force on the abutments for moving both abutments axially inwardly together in opposition to the force of the spring means. This is done for the purpose of rotating the propeller blades in the first direction. The energy that is stored in the spring means when compressed serves to rotate the propeller blades in the opposite direction when the axially inwardly directed force is removed from the abutments. The movement of both abutments results in the spring means being compressed at both of its ends. In this manner, the amount of energy stored in the spring means is double the force that is stored in the return springs of the conventional systems.

According to one embodiment of the invention, a pinion gear is connected to an inner end portion of each propeller blade within the hub. Each pinion gear meshes with two racks, one extending from each abutment. In this embodiment it is possible to obtain at least a full one hundred and eighty degrees of rotation of the propeller blades with no change in leverage. Forces on the propeller blades are balanced because the pinion gears are driven by two racks, contacting the pinion gears at diametrically opposite locations. In this system, if one of the racks should fail, a second rack will continue to be operable to vary the pitch of the individual blade.

This system is further enhanced by keying each rack to the hub wall for bracing and guidance. In addition to the bracing and guidance provided, this arrangement also permits the abutments to act on two diametrically opposite racks on one pinion even if one of the racks is broken from the abutment, in that a broken rack will remain in place due to the keying structure.

Preferably, fluid pressure is employed for moving the two abutments together, to rotate the propeller blades in one direction and store energy in the compression spring means. Fluid pressure may be applied against either one or both of the abutments within the hub. In a system in which fluid pressure is applied against only one of the abutments, movement of such abutment and the resulting rotation of the propeller blades causes the mechanical drive means which is interconnected between the propeller blades and the second abutment to move the second abutment. In this type of system, the forces on the propeller blades are still balanced.

In one mode of the invention, the fluid motor means for rotating the propeller in at least one direction is within the hub and the fluid enters and leaves the hub via a swivel structure connected to the rear end of the hub. In this structure, the propeller is adapted to be mounted onto the after end of a solid drive shaft.

It is thus an object of the invention to provide a system for varying the pitch of the blades of an adjustable pitch propeller in a simple and inexpensive manner while providing good mechanical advantage in a large return force, by use of a compression spring or springs, along with a dual rack drive for each pinion gear, the racks providing a balancing of operating forces along with the reliability of dual operation, even in the event of a dismemberment of one of the racks from an abutment.

Another object of the invention is to provide an adjustable pitch propeller in which fluid motor means are positioned forwardly of the hub and drive shaft and are adapted to move elements extending from the fluid motor means through the drive shaft and connected in the hub to the abutments. The action of the fluid motor means thereby moves the abutments axially inwardly by means of elements extending through the shaft. This embodiment provides for more space within the hub for purposes of reassembly and repair work and also provides for additional space for the use of more than one spring extending between the abutments. In this mode the actuating fluid does not enter the hub but acts upon two pistons sealingly engaged in a cylindrical member from which the elements extend, slidably engaged one within the other, into the drive shaft and the hub. The actuating fluid enters and leaves the cylindrical member via a swivel structure connected forwardly of the cylindrical member and of the drive shaft.

In a variation of the foregoing embodiment, the springs may be employed within the cylindrical member in sets acting against the two pistons. In this arrangement, the inner ends of each of the set of springs are compressed by the movements of the pistons so that the energy stored in each set of springs is at the end against the pistons, but because there are two sets, the force is double that stored in the conventional systems.

In a further embodiment of the invention, a toggle lever is connected to the inner end of each propeller blade and a toggle is interconnected between each end of the toggle lever and one of the abutments. Movement of the abutments and the toggles cause a rotation of the toggle levers and the propeller blades, to which they are connected. In this embodiment, fluid pressure is employed as indicated above.

Yet another object of the invention is to provide a novel dual rack drive for rotating a propeller blade, regardless of the nature and arrangement of the rack driving force.

Still another object of the invention is to provide an improved manner of mounting the individual blades for rotation, and of securing them to the hub structure.

It is to be understood that the blade angle adjusting features of the invention have applications to air turbines (e.g. windmills) and other impellers as well as with propellers.

These and other objects, features, and advantages of the present invention will be apparent from the preferred embodiments of the invention which are described below in conjunction with the drawings.

BRIEF DESCRIPTION OF THE DRAWINGS

Throughout the several figures, like reference designations are used to identify like parts, and:

FIG. 1 is a side elevational view of a propeller region of a marine vehicle, with a portion of a strut, that is between the propeller and the vehicle's rudder, the strut being cut away for the purpose of illustrating components therein;

FIG. 4 is an axial section view taken along the hub structure of FIGS. 2 and 3, substantially along the line 4—4 of FIG. 2;

FIG. 5 is a view like FIG. 2, but of a modified form of the invention;

FIG. 6 is a sectional view taken through FIG. 5, substantially along lines 6—6, with some of the parts omitted;

FIG. 7 is a fragmentary section view taken substantially along the lines 7—7 of FIG. 6.

BEST MODES FOR CARRYING OUT THE INVENTION

Figure 2:
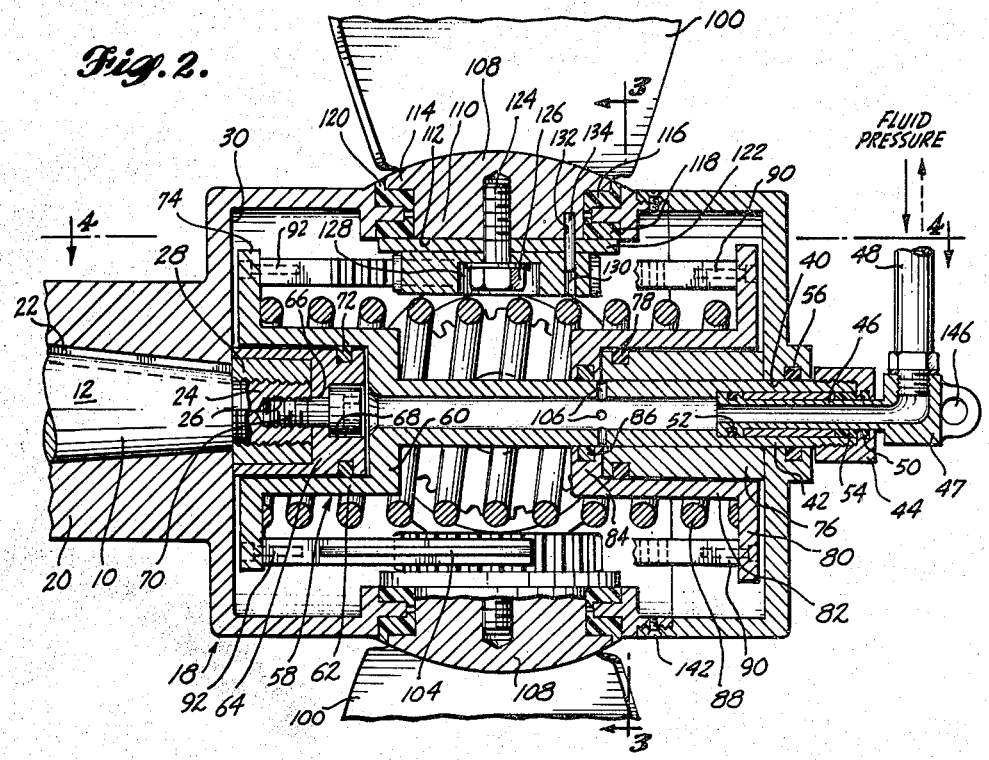
FIG. 2 is an axial section view of the hub portion of one embodiment of the invention.

FIG. 1 shows an embodiment of an adjustable pitch propeller mounted onto an after end portion 10, FIG. 2, of a solid propeller shaft 12, rearwardly of a bearing housing 14 and forwardly of a support strut 16.

In accordance with conventional practice, a bearing, not shown, and a seal, not shown, are provided within the housing 14. The after portion of the propeller shaft 12 projects rearwardly out from the housing 14 in an overhung fashion. A feature of this mode of the invention is that the adjustable propeller is adapted for use with a solid propeller shaft.

Referring now to FIGS. 2 and 4, the propeller comprises a hub 18 having a forward end portion 20, adapted to be mounted on the rearwardly tapering after end portion 10 of the drive shaft 12. A keyway is formed in both shaft portion 10 and hub portion 20, to receive a key 22 which serves to prevent relative rotation between the hub structure 18 and the propeller shaft 12 in a well-known manner. An extreme after end portion 24 of the shaft 12 is externally threaded and it also is formed to include an internally threaded socket 26. A nut 28 is threaded onto the end portion 24 for securing the hub structure 18 against axial movement relative to the shaft 12. As shown in FIG. 2, a portion of the forward end of nut 28 bears against an internal radial wall 30 provided at the front end of the hub 18.

In FIG. 1, the strut 16 is a streamlined cross-sectional shape. The strut is positioned immediately forwardly of the forward edge 32 of a rudder 34. The rudder is connected to a drive shaft 36, which when rotated moves the rudder from side-to-side. In a manner known per se, a stub shaft and a support bearing are provided at 38 for supporting the lower end of the rudder 34 about the axis of the shaft 36, and for carrying radial loads as well.

Referring again to FIGS. 2 and 4, the after end of hub 18 is formed to include a central opening 40 through which a tubular shaft 42 projects. The member 42 is externally threaded at its after end for receiving the internal threads of a closure cap 44. The cap 44 had a radial end wall at its after end which in turn includes a central opening for receiving a forwardly projecting, non-rotating tube 46, connected at the lower end of a vertically extending tube 48 by means of an elbow 47. The closure 44 includes a dynamic seal 50 provided for preventing leakage between the rotating closure 44 and the non-rotating tube 46. Dynamic seals 52 and 54 are provided between the non-rotating tube 46 and the rotating member 42. The hub 18 carrys a static seal 56 at its rear end for sealing between the hub and the rotating member 42.

In the embodiment of FIGS. 1–4 the member 42 which rotates with the hub is provided with a forwardly opening cut-like forward end portion 58. End portion 58 comprises a radial wall 60 and an axial wall 62.

A cup-shaped rotating plug 64 includes a forwardly opening socket sized to snugly fit over the nut 28. The member 46 includes a radial rear end wall provided with a central axial opening 66 and a countersink 68. The socket 68 is provided to receive the head portion of a bolt 70 which screws into the internally threaded socket formed in shaft end portion 24, and serves to connect the plug 64 to the shaft 12. Thus, the plug 64 rotates with the shaft 12. The head of bolt 70 may be provided with a hexagonal socket for receiving an Allen wrench.

Plug 64 is formed to have a peripheral girth groove for receiving an annular seal 72, to seal against leakage between the axially movable member 58 and the axially stationary member 64.

In this embodiment, a first abutment 74 is provided at the forward end of the member 58. The abutment 74 projects radially outwardly from the axial wall 62.

At the other end of the hub a sleeve 76 is provided to snugly fit on a rear portion of the tubular member 42 and is formed to include a peripheral girth groove for receiving an annular seal 78. A second abutment 80 is provided at the rear end of the hub structure. Abutment 80 projects radially outwardly from a tubular axial wall 82 which projects axially forwardly into a radial wall 84 having an inner peripheral groove to receive an annular seal 86 on the member 42. The seal 78 provides a tight fluid seal between the forward end of the member 76 and a surrounding portion of the tubular wall 82.

The cup-shaped members 60, 62 and 82, 84 and the two plug members 64, 76, respectively therein, define expansible fluid chambers at the front and rear ends of the generally hollow interior of the hub structure 18. The hub structure 18 and the parts therein thus rotate with respect to the member 14 and the tube 46, the elbow 47 and the vertical tube 48. The member 58 is adapted to reciprocate axially on the plug member 64 and similarly the cup-shaped member 82, 84 is adapted to reciprocate on the member 76 and on the member 42.

The parts 46, 47 and 48 and the seals 50, 52, 54 and 56 define what may be termed a "swivel" structure with respect to the hub and specifically with respect to the membe 42 and the member 44 threadedly engaged on the latter. The function of the seivel structure is to deliver fluid pressure into and out of the interior of the hub 18. The parts 46, 47 and 48 are the stationary components of the swivel and the rear end portion of the hub, including the members 42 and 44 are the rotating components of the swivel.

According to a very important aspect of the invention, a compression spring 88 is positioned within the hub, having its opposite ends bear against the radial abutments 74 and 80. Its two end portions preferably closely surround the axial walls, 62 and 82.

Figure 3:
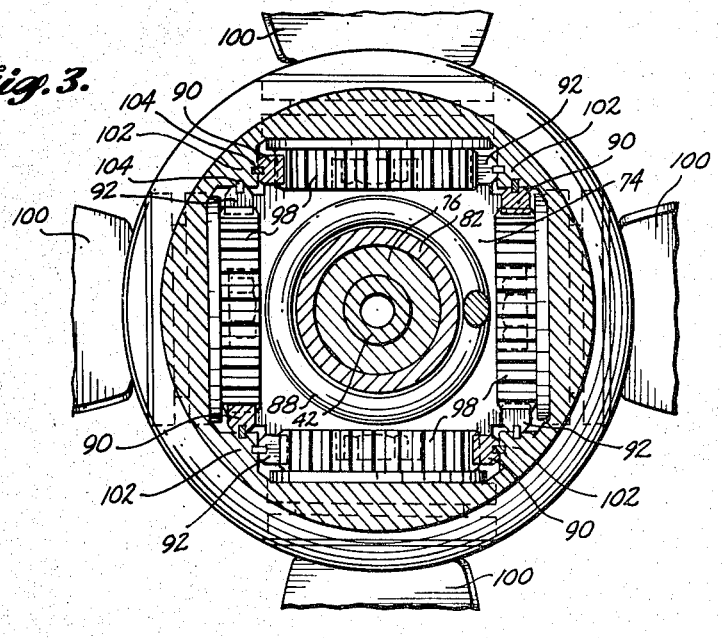
FIG. 3 is a cross-sectional view taken through the hub structure of FIG. 2, substantially along the line 3—3.

As shown in FIGS. 2–4, eight racks are housed within the hub structure 18. Four of the racks, designated as 90, are connected at one end to the abutment 80 and the other four racks, designated as 92, are connected at one end to the abutment 74. The racks 90, 92 are connected to the respective abutments 80, 74 by Allen wrench bolts which extend through openings provided in the abutments and thread internally into axially extending tapped bores in the abutment ends of the racks 90, 92. As shown in FIGS. 2 and 4, the head portions of the bolts are received within countersinks formed in the outer portions of the abutments. In FIG. 4 the mounted ends of the racks 90, 92 are shown to be enlarged to provide room for receiving the two spaced bolts and for strengthening the racks at their connections to the abutments.

As shown in FIGS. 2–4, laterally inwardly directed teeth 94 of the racks 90, 92 mesh with teeth 96 on pinion gears 98, connected to the inner end portions of the propeller blades 100.

In FIG. 3 the central inner portion of the hub housing is shown in cross-sectional end view and includes four axially extending ribs 102, each having a pair of 90 degree related side surfaces. Each side surface is adjacent the back surface of a rack 90, 92. Axial grooves are formed in both the ribs 102 and the back portions of the racks 90, 92, to receive guide keys 104, provided for stabilizing the racks. The keys 104 are carried by the racks so that they move therewith as they reciprocate relative to the ribs 102.

As can be determined from FIGS. 2–4, two racks are associated with each pinion gear 98. One rack 90, connected to the abutment 80, engages each pinion gear 98 at a first peripheral location. A rack 92, connected to the abutment 74, engages each pinion gear at a second peripheral location spaced diametrically across the pinion gear 98 from the location of the engagement of rack 90 and the pinion gear 98.

As shown in FIG. 2, when the interior of tubular member 42 is vented to remove the fluid force from the abutments 74 and 80, the compression spring 88 forces the abutments 74, 80 axially outwardly into the end position shown in FIGS. 2 and 4. When the parts are in this position the blades 100 are also in an end position. Preferably they are in a high pitch forward position. When it is desired to change the pitch of the blades 100, fluid pressure is introduced through the vertical swivel tube 48 to the interior of tube 42. Some of this pressure is communicated via radial ports 106 into the expansible chamber formed by plug member 76 and wall members 82 and 84. The pressure is also communicated with the interior of the second expansible chamber formed by plug member 64 and wall members 60 and 62. As the fluid pressure is introduced into the expansible chambers, the wall member 60 is moved to the right, as pictured in FIG. 2 and the wall 84 is moved to the left. This causes the abutments 74, 80 to move axially inwardly toward each other, moving the racks 90, 92 with them. The racks apply torque to the pinion gears 98 to rotate the propeller blades 100.

At the same time the compression spring 88 is compressed at both of its ends. This means that for each increment of rotation of the propeller blades 100 the compression spring is compressed by an amount that is double the amount of compression of a conventional return spring which is moved only at one end and held at the opposite end. Also, as a result of this arrangement, the driving force is applied to the propeller blades at two diametrically opposed locations.

This mechanical arrangement, including the bracing and guiding of the racks with the keys and grooves, provides a balanced and reliable structure. If one rack fails, the other will still function and even a broken rack, held in place by the key, groove and pinion, can be moved by the abutment to drive the pinion.

Fluid pressure is vented from the interior of tube 42 when it is desired to reverse the rotation of the propeller blades 100. In the event of some malfunction of the fluid supply system, resulting in a complete venting of the fluid pressure within the tube 42, the spring 88 will return the abutments to the end positions, shown in FIGS. 2 and 4. As earlier mentioned, it is preferred that these end positions rotate the blades so as to be in a high pitch forward position. Then, if the fluid control system should malfunction for some reason, the propeller would automatically return by the compression spring to its forward high pitch position, rather than being stuck in reverse or some other less desirable position.

The arrangement of the parts within the hub 18 permits the use of a relatively large diameter husky spring 88. Movement of the spring is stabilized by the fact that the end portions surroundingly engage the movable tubular walls 62, 82. Accordingly, the spring 88 is capable of developing a large force for driving the propeller blades 100 toward the end position shown in FIGS. 2 and 4.

A preferred manner of removably mounting the propeller blades 100 is illustrated in FIG. 2. Each propeller blade 100 includes a mounting base portion 108 which has a cylindrical end portion 110 having a flat radial end surface 112. A circumferential flange 114 extends radially beyond the cylindrical end portion 110 along the inner end of the blade 100.

At each blade location the hub 18 is an oversized generally cylindrical opening to receive the cylindrical end portion 110 of the blade. The opening is bounded on its inside and its outside by a shallow bushing sockets. An annular outer bushing 116 is fitted within the outer bushing socket and an inner annular bushing 118 is located within the inner bushing socket. The bushing 116 includes an axially extending portion 120, filling a space between the outer periphery of the flange 114 and an adjacent cylindrical wall portion of the outer bushing socket. Preferably, bushings 116, 118 are constructed from a plastic bushing material, such as nylon.

A large washer 122 abuts the inner end surface 112 of the blade and the inner surface of inner bushing 118. A pinion gear 98 is positioned immediately inwardly of the washer 122. A bolt 124 extends through central openings in the gear 98 and the washer 122 and threads into an internally threaded socket formed in base member 108. The center line axis of the socket coincides with the axis of rotation of the propeller blade 100. The bolt 124 has a head 126 received within a countersink 128 in the inner central portion of the gear 98.

In the pinion gear and the washer 122 there are axial openings 130 and 132, respectively, for receiving a pin 134 which extends parallel to the bolt 124, the pin being spaced from the bolt radially outwardly so that the two members together prevent rotation of the pinion and the washer relative to the propeller 100. The blade end of the pin 134 fits snugly within a blind socket formed in the blade base 108.

The hub structure 18 is constructed in two parts, a forward major part 136 and a rearward minor part 140. The blade mounting portions are parts of the forward part 136. The rearward part 140 is a removable cover. A threaded connection is provided where the two parts are joined and a plurality of countersunk bolts 142 are provided for securing the two parts 138, 142 together at the threaded connection, so that the part 140 will not become unintentionally unscrewed from the part 138.

The propeller may be assembled as follows:

The hub structure 18, with the blades 100 removed and the rear end member 140 removed, is set into place on the rear end portion 10 of the propeller drive shaft 12. This includes locating the key 22 within the key slots in the end portion 20 of the hub and the end portion 10 of the propeller shaft 12. Next, the nut 28 is inserted into the hub through the open rear end and it is screwed into place and tightened. Then, plug member 64 is set onto the nut 28 and is secured into place by the bolt 70. The member which includes the tube 42 wall members 60, 62 and the abutment 74 is inserted into the hub structure, with the racks 92 attached thereto. The racks 90 are also set into place. Then, the propeller blades are assembled. The bushings 116, 118 are set into the bushing sockets. The base of each blade 100 is inserted into its opening in the side wall of the hub. The washer 122, pin 134 and pinion 98 are set in place and bolt 124 is installed and tightened. The bolt may include a hexagonal recess in its head for receiving the end portion of an Allen wrench.

After the propeller blades have been assembled, the spring 88 is installed followed by member 80, 82, 84, and then member 76. The abutment 80 is then secured to the racks 90 by the countersunk bolts. Next the hub closure 140 is installed and locked into place by the bolts 142. Lastly, the parts 46, 54, 44 and 48 are installed.

The strut 16, FIG. 1, is constructed so that it can be opened for the purpose of installing the parts 46, 47 and 48 of the swivel structure whereby fluid pressure may be supplied to the interior of the hub structure.

As may be seen from FIG. 2, the swivel fitting 46, 47 moves axially as the member 42 moves. A mechanical feedback, in the form of a tensioned line 144, FIG. 1, is connected to an eye 146 at the rear end of the elbow 47. The tension member 144 runs rearwardly from the eye 146 and then up and around a pulley 148, and then upwardly through the interior of the strut to a device for indicating the position of the elbow 47 and in turn the position for pitch of the propeller blades 100.

Figure 8:
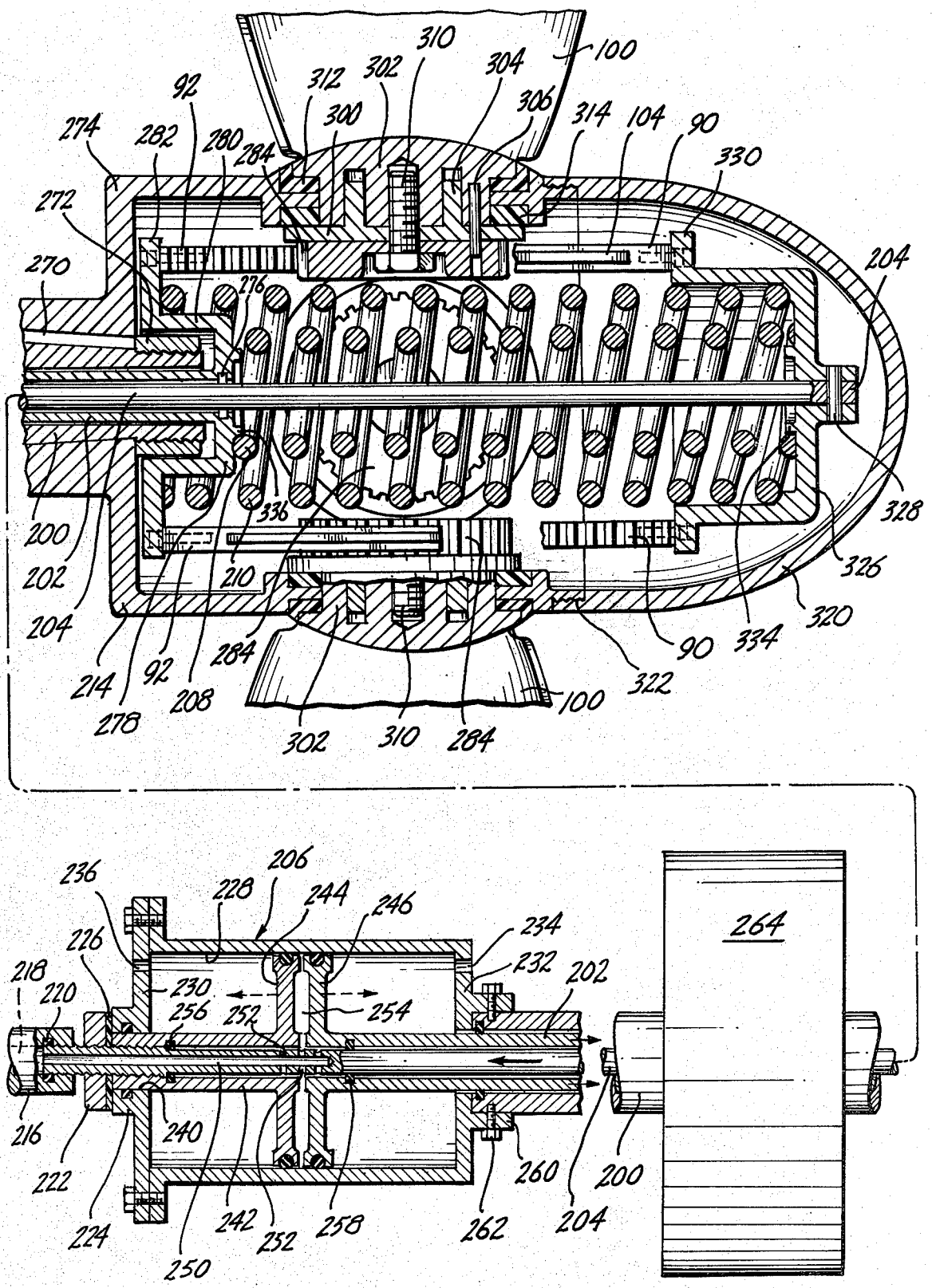
FIG. 8 is an exploded view, substantially in section, of a mode of the invention having fluid motor means forwardly of the propeller.

In FIG. 8 another preferred mode of the invention is illustrated. Here, the drive shaft 200 is hollow and carries elements including a tubular member 202 in which a rod 204 is slidably engaged. This permits a fluid motor, generally designated as 206, to be forwardly of the hub, permits more space within the hub for two compression springs 208 and 210, and also permits additional space for assembly and disassembly of the propeller and hub structure 214.

Extending forwardly of the fluid motor 206 is an axially movable swivel connection 216, adapted to function with a swivel similar to the swivel structure 46, 47 and 48 in FIG. 2. The member 216 is of tubular configuration and has a central opening 218. The forward end portion of the rod 204 is threadedly engaged in the tube 216 and sealed therein by an annular seal 220. A limiting-adjusting nut 222 is threadedly engaged on the rod 204 and between the nut and an end wall 224 of the fluid motor there is a thrust bearing 226 to receive the nut when it is returned to the wall during the axial movement for varying the pitch of the blades.

The fluid motor 206 is comprised of a generally cylindrical member having an inner cylindrical sealable wall 228. At the ends of the wall 228 are two walls 230 and 232, both open to the atmosphere by apertures 234 and 236. In the wall 230 there is a cylindrical bore 240 through which a tubular member 242 is adapted to move axially. The rod 204 is threadedly engaged within the tube 242 so that they move together. At the inner end of the tube 242, with respect to the fluid motor 206, there is a piston 244, slidably and sealingly engaged with the cylindrical wall 228. Juxtaposed and spaced from the piston 244 is a second piston 246 also slidably and sealingly engaged within the cylindrical wall 228. The piston 246 is on the forward end of the tube 202.

A central tubular opening 250 extending inwardly in the motor from the end of the rod 204 delivers fluid into the rod and through orifices 252 into a sealed chamber 254 between the pistons 244 and 246 to move the pistons apart. Annular seals 256 and 258 seal the chamber 254 along the rod and the tubes 242 and 202.

An annular wall 260 extends rearwardly from the wall 232 to receive the drive shaft therein, the drive shaft being secured thereto by means of bolts 262. The fluid motor 206, the parts therein, and the member 216 thus rotate with the drive shaft. Rearwardly of the fluid motor, the drive shaft extends through a gear box and thrust structure 264, the gears being connected to the boat motor and being engaged with a gear on the drive shaft to rotate the same to drive the boat.

A spline 270 joins the hub 214 and the drive shaft 200 at its rearward end so that the shaft positively rotates the hub. A nut 272, tightened on the rearward end of the shaft and in abutment with a wall 274 of the hub, secures the hub and the shaft together axially. The rod 204 extends rearwardly beyond the shaft and is supported on a bearing 276 for axial movement with respect to the tube 202. A radial flange 278 extends from the tube and from its periphery extends a forwardly extending ring 280 surrounding the nut 272. At the forward end of the ring is a radially extending annular abutment 282.

Secured to the abutment, adjacent its circumference are four spaced racks 92, as shown in FIGS. 2 and 3. The racks each being engaged with a pinion gear 284. The gears 284 are substantially the same as the gears 98 but have annular flange members 300 in contact with inner cylindrical ends 302 of the blades 100. Extending into the cylindrical portions of the blades are ribs 304 for rotative support. The gears 284 also have pins 306 extending therethrough and into the blade base in the same manner as the pins 134. The blades 100 are secured in the hub by means of a bolt 310 in the same manner as the blades in FIG. 2. Bushings 312 and 314 support the blades in the hub for pitch rotation. Similar to the hub 18 in FIG. 2, the rearward end of the hub 214 is formed by a cover 320 and is threadedly engaged with the hub at 322. In addition to the threads at 322 there are circumferentially spaced bolts, not shown, to further secure the hub parts together.

The outer end of the rod 204 extends into a bore in a cup-shaped member 326 and is secured therein by means of a pin 328. At the forward end of the cup there is an annular flange which forms a rearward abutment 330. The abutment here is similar to that shown in FIG. 2 in that it has four racks 90 secured thereto by bolts, the racks being further supported in the hub by keys 104, as shown in FIG. 3. Each of the racks 90 is meshed with one of the four pinion gears 284 in the same manner as described with respect to FIGS. 2 and 3.

The larger diameter coil spring 210 has its respective ends in contact with the abutments to bias them apart and the smaller diameter spring 208 has its rearward end in contact with the base of the cup member 326 outwardly of an annular protrusion 334, and similarly, the forward end of the spring abuts the wall 278 outwardly of an annular protrusion 336, the respective protrusions being adapted to properly position the smaller spring radially. The spring 210 is positioned radially by the wall 280 and the cup 326.

When the interior of the chamber 254 and the bore 250 in the rod 204 are vented to remove the fluid force from the abutments 282 and 330, the compression springs 208 and 210 force the abutments axially outwardly into the end position as shown in FIG. 8. As described above with respect to FIGS. 2 and 4, when the parts are in this position the blades 100 are also in an end position, preferably in a high pitch forward position. When it is desired to change the pitch of the blades, fluid pressure is introduced through the passage 218 of the tube 216, into passage 250 and through orifices 252 into the chamber 254 between the pistons 244 and 246. As the pressure is increased, the pistons enlarge the chamber to move the tube 202 and the abutment 282 connected thereto axially inwardly, with respect to the hub, and to move the piston 244 forwardly so as to move the rod 204 in the same direction and move the abutment 330 axially inwardly toward the abutment 282, both abutments moving simultaneously against the ends of the springs. At the same time the abutments move racks 90 and 92 so as to apply torque to the pinion gears 284 to rotate the propeller blades 100.

Because the compression springs are compressed at both ends for each increment of rotation of the blades 100, the springs are compressed an amount that is double the amount of the compression of a conventional return spring or springs, being moved only at one end and held at the opposite. Also as described above, the driving force is applied to each propeller blade at two diametrically opposed locations.

Another preferred mode of the invention would include two sets of coil springs within the cylinder 228, one set being between piston 244 and wall 230, the other set being between piston 246 and wall 232. This would permit removal of the springs from the hub but would achieve compression of two ends of the springs, one end in each set, simultaneously, double that of the conventional return spring.

In FIGS. 5–7, there is shown a modified form of the invention in which the pinion gears at the bases of the propeller blades have been replaced by toggle levers 150. In this form the construction of the hub housing is basically the same as that in FIGS. 1–4, the blades 100 being mounted in essentially the same way as the blades in the earlier form. Thus, the same references numerals will be used to designate the like parts in the discussion of this embodiment.

As best shown by FIG. 6, the toggle levers 150 include diametrically opposed apertured ears 152, 154. A toggle 156 is interconnected between the abutment 74' and each apertured ear 152. A toggle 156 is also interconnected between each apertured ear 154 and the abutment 80'. Pivot pins are used to pivotally connect together the apertured ears 152, 154 and the toggle lever ends of the toggles 156. A universal joint 158 connects the abutment end of each toggle 156 to its abutment 74' or 80'. The universal joint may be in the nature of a ball and socket joint, with the ball member being a spherically headed end of a bolt which threads into an axially extending, internally threaded blind socket formed in the abutment end of the toggle 156. The socket is formed in the abutment 74' or 80' about the opening through which the bolt extends. The spherically headed bolt may include a screw driver slot so that it can be screwed into place.

In this embodiment, a pair of compression springs 160, 162 are located between the two abutments 74', 80'. Also, in this embodiment, only one expansible chamber is provided and it is provided at the rear end of the hub structure 18'.

The abutment 74' is connected to the propeller shaft end of a member 164 which extends axially through the hub 18' and at its after end is externally threaded so that it can be connected to a nipple 166. In this embodiment the abutment 80' is in the nature of a piston and the detachable after end portion 140' of the hub housing functions as a cylinder. A seal 168 is carried at the periphery of abutment 80'. Seal 168 makes sealing engagement with the inner surface of the tubular side wall of housing portion 140'. Abutment 80' is a part of a member which also includes an elongated axially extending portion 170 which surrounds a sleeve 172 which in turn surrounds a reduced diameter portion of member 164. Annular seals 174 are provided at the inner end of sleeve 172, to provide a seal between themselves and the sliding tubular member 170. A seal member 176 is provided at the after end of housing portion 140', to seal between it and an axially extending portion 178 of member 166.

The abutment end of tubular portion 170 has an internal diameter which is sufficiently larger than the external diameter 164 to provide an annular fluid passageway 180. A plurality of radial ports 182 are provided through the side walls of tube 164 and sleeve 172, for communicating the interior of tube 164 with the chamber 180. Chamber 180 in turn communicates with an expansible chamber which is defined axially between abutment 80' and end wall 184 of housing part 140'.

In operation, fluid pressure and flow are communicated with the chamber 182. The fluid flows through ports 182 into passageway 180, and from passageway 180 into the expansible chamber 188. The fluid pressure exerts an axially inwardly directed force on piston-abutment 80', moving it to the left, as pictured. As the abutment 80' moves it pushes on the toggles 156 that are connected to it, causing them to in turn apply torque to the toggle levers 152 and the propeller blades 100 connected thereto. In this embodiment, toggle lever rotation causes the toggles 156 which are connected to the second abutment 74' to exert a pulling force on abutment 74', so that it also moves axially inwardly. Thus, the compression springs 160, 162 are compressed at both of their ends, between the two abutments, as the abutments 74', 80' are positively driven together.

As was the case in the first embodiment, when fluid pressure is released from the chamber 186, the compression spring means 160, 162 will serve to both return the abutments 74' 80' to their seated positions (FIG. 5) and will rotate the propeller blades 100 back towards their starting position.

It is claimed:

1. An adjustable pitch propeller comprising a hollow hub, a plurality of adjustable pitch propeller blades mounted on said hub, each of said blades having an inner portion which is located within said hub, and an improved mechanism for adjusting the pitch of said propeller blades, comprising:

a pair of axially movable abutments spaced axially apart within said hub;

compression spring means positioned between said abutments, with each end of said spring means bearing against one of said abutments, said spring means normally biasing both of the abutments axially outwardly;

a mechanical drive means interconnected between each abutment and the inner end portion of each blade, each said mechanical drive means functioning to apply a pitch changing rotational force on its blade in response to an axial movement of its abutment; and means for applying an axially inward force on said abutments for moving both abutments axially inwardly together, in opposition to the force of said spring means, for the purpose of rotating the propeller blades in a first direction, with the energy that is stored in such spring means when it is compressed serving to rotate the propeller blades in the opposite direction when the axially inwardly directed force is removed from the abutments, whereby movement of both abutments results in the spring means being compressed at each end.

2. An adjustable pitch propeller according to claim 1, wherein one of said abutments includes an elongated guide shaft connected thereto, extending axially of the hub, and the second abutment is mounted on said guide shaft to slide axially thereon.

3. An adjustable pitch propeller according to claim 2, wherein at least one expansible fluid chamber is formed within said hub, of which one of the abutments includes a movable wall for such chamber, and said guide shaft includes a fluid passageway through which fluid flows into and outfrom said expansible chamber.

4. An adjustable pitch propeller according to claim 3, wherein a separate expansible chamber is associated with each said abutment, and each abutment provides a movable wall for its expansible chamber, and said passageway delivers fluid into and outfrom each such expansible chamber.

5. An adjustable pitch propeller according to claim 3, wherein there is only one expansible chamber and it is associated with a first one of the abutments, and wherein delivery of fluid into such chamber causes the abutment to move and such movement causes the mechanical drive means connected to such abutment to rotate the propeller blades, and rotation of the propeller blades drives the mechanical drive means connected to the second abutment, causing it to move towards the first abutment, so that the compressing spring is compressed from both ends.

6. An adjustable pitch propeller according to claim 1, wherein said mechanical drive means comprises a pinion gear attached to the base of each propeller blade, and a separate drive rack extending axially inwardly from each abutment to each pinion gear, with the rack for each abutment engaging its gear wheel at a location which is diametrically opposite where the rack extending from the other abutment engages such pinion gear.

7. An adjustable pitch propeller according to claim 6, wherein the rack and pinion drive is adapted to rotate the propeller blades at least 180 degrees during movement of the two abutments from one end position to the other end position.

8. An adjustable pitch propeller according to claim 6, wherein said spring means engages the abutments at locations radially inwardly of said racks.

9. An adjustable pitch propeller according to claim 8, wherein each abutment includes a radial end wall against which an end of the spring means presses, and an axial portion which projects axially inwardly from said radial portion, and wherein the end portions of the compression spring means surrounds the axial portions of the abutments.

10. An adjustable pitch propeller according to claim 6, wherein the hollow hub includes wall means adjacent which said racks extends, and said propeller further includes key means extending between said racks and the wall means, for bracing and guiding the racks.

11. An adjustable pitch propeller according to claim 10, wherein said key means comprises an axial groove formed in a back portion of each rack, a similar axial groove formed in each portion of the wall means that is adjacent a said rack, and an elongated key member which fits partially within one such groove and partially within the other such groove.

12. An adjustable pitch propeller according to claim 1, wherein each abutment includes a radial end wall against which an end of the spring means presses, and an axial portion which projects axially inwardly from said radial endwall, and wherein the end portions of the compression spring means surrounds the axial portions of the abutments.

13. An adjustable pitch propeller according to claim 12, further comprising fluid motor means within said hub for causing movement of said abutment means together, to move the mechanical drive means, to rotate the propeller blades, and to compress the spring means between the two abutments.

14. An adjustable pitch propeller according to claim 1, wherein said mechanical drive means comprises a toggle drive member attached to the base of each propeller blade, and including a pair of diametrically opposed ears extending radially therefrom, a toggle rod interconnected between each ear and an associated one of the abutments, with axial movement of the abutments causing the toggle rods to push on the ears of the toggle drive member and in that manner cause rotation of the propeller blade.

15. An adjustable pitch propeller according to claim 1, further comprising fluid operated motor means within said hub for moving the two abutments together, to cause operation of the mechanical drive means resulting in a pitch changing rotational force being applied to the propeller blades, and movement of the two abutments together, compressing the spring means between them, with venting of the fluid drive means causing the spring means to extend and drive the mechanical drive means and the propeller blades in the opposite direction.

16. An adjustable pitch propeller according to claim 15, wherein the propeller hub includes means at one of its ends for mounting it onto the after end of a propeller shaft, and a swivel means at its opposite end through which operating fluid is supplied and returned to and from the motor means.

17. An adjustable pitch propeller comprising:

a hub having a forward end portion adapted to be mounted onto a rearward end of a propeller shaft;

means for securing said hub to said shaft;

a plurality of adjustable pitch propeller blades mounted on said hub, each said propeller having an inner end portion which is located within said hub;

means for changing the pitch of said propeller blades including axially movable means within said hub, movement of which is controlled by fluid pressure;

means for supplying a fluid pressure to cause such movement, said means including a swivel at the rear end of said hub and fluid delivery line means connected to said swivel; and wherein the means for changing the pitch of the propeller blades further includes a pair of axially moveable abutments spaced axially apart within said hub;

compression spring means positioned between said abutments, with each end of said spring means bearing against one of said abutments, said spring means normally biasing both of the abutments axially outardly;

a mechanical drive means interconnected between each abutment and the inner end portion of each blade, each said mechanical drive means functioning to apply a pitch changing rotational force on its blade in response to an axial movement of its abutment; and a fluid motor means for applying an axially inward force on said abutments, for moving both abutments axially inwardly together, in opposition to the force of said spring means, for the purpose of rotating the propeller blades in a first direction, with the energy that is stored in such spring means when it is compressed serving to rotate the propeller blades in the opposite direction when the axially inwardly directed force provided by the fluid motor means is removed from the abutments.

18. An adjustable pitch propeller according to claim 17, wherein one of said abutments includes an elongated guide shaft connected thereto, extending axially of the hub, and the second abutment is mounted on said guide shaft to slide axially thereon.

19. An adjustable pitch propeller according to claim 18, wherein at least one expansible fluid chamber is formed within said hub, of which one of the abutments includes a moveable wall for such chamber, and said guide shaft includes a fluid passageway through which fluid flows into and outfrom said expansible chamber.

20. An adjustable pitch propeller according to claim 19, wherein a separate expansible chamber is associated with each said abutment, and each abutment provides a moveable wall for its expansible chamber, and said passageway delivers fluid into and outfrom each such expansible chamber.

21. An adjustable pitch propeller according to claim 19, wherein there is only one expansible chamber and it is associated with a first one of the abutments, and wherein delivery of fluid into such chamber causes the abutment to move and such movement causes the mechanical drive means connected to such abutment to rotate the propeller blades, and rotation of the propeller blades drives the mechanical drive means connected to the second abutment, causing the second abutment to move towards the first abutment, so that the compression spring is compressed from both ends.

22. An adjustable pitch propeller according to claim 17, wherein said mechanical drive means comprises a pinion gear attached to the base of each propeller blade, and a separate drive rack extending axially inwardly from each abutment to each pinion gear, with the rack for each abutment engaging its gear wheel at a location which is diametrically opposite where the rack extending from the other abutment engages such pinion gear.

23. An adjustable pitch propeller according to claim 22, wherein the rack and pinion drive is adapted to rotate the propeller blades at least 180 degrees during movement of the two abutments from one end position to the other end position.

24. An adjustable pitch propeller according to claim 22, wherein said spring means engages the abutments at locations radially inwardly of said racks.

25. An adjustable pitch propeller according to claim 24, wherein each abutment includes a radial end wall against which an end of the spring means presses, and an axial portion which projects axially inwardly from said radial portion, and wherein the end portions of the compression spring means surrounds the axial portions of the abutments.

26. An adjustable pitch propeller according to claim 22, wherein the hollow hub includes wall means adjacent which said racks extend, and said propeller further includes key means extending between said racks and the wall means, for bracing and guiding the racks.

27. An adjustable pitch propeller according to claim 26, wherein said key means comprises an axial groove formed in a back portion of each rack, a similar axial groove formed in each portion of the wall means that is adjacent a said racks, and an elongated key member which fits partially within one such groove and partially within the other such groove.

28. An adjustable pitch propeller having a hollow hub including a peripheral blade mounting portion comprising:

a circular opening and an annular wall surrounding said opening which is flat on both its sides, a pair of annular plastic bushings, one on each side of said annular wall;

a propeller blade including an elongated blade portion having inner and outer ends and a mounting base at its inner end;

said mounting base comprising a cylindrical end portion sized to fit through both bushings and the opening in the mounting portion of the hub;

an annular flange extending about said cylindrical portion at the end thereof adjacent the blade portion, presenting an inner surface which rests against an outside surface of the outer bushing;

a flat end surface at the opposite end of said cylindrical portion which is substantially flush with the inside surface of the inner bushing;

means for securing the propeller blade in place on the hub comprising a wall member which is positionable against the inner end surface of said blade hub and extends radially beyond the cylindrical portion of said hub to inwardly bound the inside surface of the inner bushing;

a propeller blade drive element inwardly of said wall member, and means for removably securing said drive element and said wall member to the base of the propeller blade;

a pair of force applying elements drivenly connected to said drive element at diametrically opposite locations;

a pair of axially moveable abutments spaced axially apart within said hub; a compressing spring means positioned between said abutments, with each end of said spring means bearing against one of said abutments, said spring means normally biasing both of the abutments axially outwardly; wherein one of the force applying members is connected to the other abutment; and means for applying an axially inward force on said abutments for moving both abutments axially inwardly together, in opposition to the force of said spring means, for the purpose of rotating the propeller blade in a first direction, with the energy that is stored in such spring when it is compressed serving to rotate the propeller blades in the opposite direction when the axially inwardly directed force is removed from the abutments.

29. An adjustable pitch propeller having a generally hollow hub, a plurality of adjustable pitch propeller blades mounted on said hub, each of said blades having an inner end portion which is located within said hub, and an improved mechanism for varying the pitch of the propeller blades, comprising:

a pair of axially movable abutments spaced axially apart within said hub;

compression spring means positioned between said abutments, each end of the spring means bearing on a respective abutment to normally bias both of the abutments axially outwardly;

a mechanical drive means interconnected between each abutment and the inner end portion of each blade, each of said mechanical drive means functioning to apply a pitch changing rotational force on its blade in response to an axial movement of its abutment;

means for applying an axially inward force on said abutments for moving both abutments axially inwardly toward each other in opposition to the force of said spring means to compress the spring means at each end and to rotate the propeller blades in a first direction, and to store energy in the compressed spring means to rotate the propeller blades in the opposite direction when the axially inwardly directed force is removed from the abutments;

a drive shaft secured to one end of said hub, said shaft and said hub being rotatable on a common axis;

said means for applying said axially inward force including a pair of internal drive shaft elements extending outwardly from said hub within the drive shaft, one of said elements being connected to one abutment and the other element being connected to the other abutment to apply said axially inward force respectively thereto; and means on said elements and rotatable with said drive shaft to receive said force and to be moved axially so as to move said abutments axially inwardly.

30. The invention according to claim 29 in which:

said spring means include a plurality of coil springs being generally concentric with respect to each other.

31. The invention according to claim 29 in which:

said internal drive shaft elements are comprised of a rod connected to one of said abutments and a tube connected to the other of said abutments;

said rod and tube being movable axially relative to each other.

32. The invention according to claim 31 in which:

said means on said elements are juxtaposed pistons having an expansible chamber therebetween;

one of said pistons being on said tube and the other being on said rod;

a fluid power passage through said rod to said chamber, said fluid being adapted to flow into and out of said chamber through said passage.

33. The invention according to claim 32 in which:

said expansible chamber is surrounded by a cylindrical member in which said pistons are sealingly engaged for axial movement;

said cylindrical member being secured to said shaft to rotate therewith.

34. The invention according to claim 33 in which:

said rod and tube being movable axially relative to each other within and outwardly of said cylindrical member.

35. The invention according to claim 34 in which:

delivery of fluid into said expansible chamber causes the abutments to be moved simultaneously axially inwardly to operate the mechanical drive means to rotate the propeller blades and to compress the spring means at both ends.

36. The invention according to claim 35 in which:

said mechanical drive means includes a pinion gear attached to a base on the inner end of each propeller blade, and a separate drive rack extending axially inwardly from each abutment to each pinion gear, with the rack for each abutment engaging its pinion gear at a location which is diametrically opposite where the rack extending from the other abutment engages the pinion gear.

37. The invention according to claim 36 in which:

the rack and pinion drives are adapted to rotate the propeller blades at least 180 degrees during movement of the two abutments from an axially outer position to an axially inner position where said spring means are compressed at both ends a predetermined amount.

38. The invention according to claim 36 in which:

the spring means bear on the abutments at locations radially inwardly of said racks.

39. The invention according to claim 36 in which:

the hub includes wall means adjacent which said racks extend, and key means extend between said racks and said wall means for bracing and guiding the racks.

40. The invention according to claim 39 in which:

said key means includes an axial groove in a back portion of each rack, a similar axial groove formed in each portion of the wall means that is adjacent a said rack, and an elongated key member which fits partially within one such groove and partially within the other such groove.

41. The invention according to claim 34 in which:

said rod is slidably engaged within said tube.

42. The invention according to claim 31 in which:

said abutment connected to said rod is cup-shaped and the bottom of the cup receives said spring means;

said cup-shaped abutment having an annular circumferential flange to which said mechanical drive means are connected;

said abutment connected to said tube has surfaces which receive said spring means and has axial protrusions which position said spring means radially;

said last abutment having an annular circumferential flange to which said mechanical drive means are connected.

43. The invention according to claim 29 in which:

said means on said elements are juxtaposed pistons, one on each of said elements;

said pistons having an expansible chamber therebetween;

a fluid power passage through one of said elements to said chamber, said fluid being adapted to flow into and out of said chamber through said passage.

44. The invention according to claim 29 including:

fluid operated motor means associated with said drive shaft for moving the two abutments toward each other to cause operation of the mechanical drive means resulting in a pitch changing rotational force being applied to the propeller blades and compressing the spring means between them, with venting of the fluid drive means causing the spring means to extend and drive the mechanical drive means and the propeller blades in the opposite direction.

45. An adjustable pitch propeller comprising:

a generally hollow hub having a forward end portion adapted to be mounted onto a rearward end of a propeller shaft;

means for securing said hub to said shaft;

a plurality of adjustable pitch propeller blades mounted on said hub, each of said propeller blades having an inner base portion located within said hub;

a pair of axially movable abutments spaced axially apart within said hub;

compression spring means positioned between said abutments, each end of the spring means bearing on a respective abutment to normally bias both of the abutments axially outwardly;

a mechanical drive means interconnected between each abutment and the inner end portion of each blade, each of said mechanical drive means functioning to apply a pitch changing rotational force on its blade in response to an axial movement of its abutment;

means within said hub for applying an axially inward force to said abutments for moving both abutments axially inwardly toward each other in opposition to the force of said spring means to compress the spring means at each end and to rotate the propeller blades in a first direction, and to store energy in the compressed spring means to rotate the propeller blades in the opposite direction when the axially inwardly directed force is removed from the abutments;

said means within said hub for applying said axially inward force including a pair of elements within the hub and adapted to extend into a drive shaft outwardly of said hub; and one of said elements being connected to one abutment and the other element being connected to the other abutment to apply said axially inward force respectively thereto.

46. The invention according to claim 45 including:

means adapted to be secured to said elements externally of said hub and drive shaft to receive said force and to be moved axially so as to move said abutments axially inwardly.

47. The invention according to claim 45 in which: one of said elements is a rod connected to one of said abutments to move it axially and the other of said elements is a tube connected to the other of said abutments to move it axially;

said rod and said tube extending forwardly outwardly of said hub, said rod being slidably engaged within said tube.

48. The invention according to claim 47 including:

means on said elements externally of said hub and of a drive shaft and rotatable with said drive shaft to receive said force and to be moved axially to move said abutments axially inwardly;

said means on said elements being juxtaposed pistons having an expansible chamber therebetween;

one of said pistons being on said tube and the other being on said rod; and a fluid power passage through said rod to said chamber, said fluid being adapted to flow into and out of said chamber through said passage.

49. The invention according to claim 48 in which:

said expansible chamber is surrounded by a cylindrical member in which said pistons are sealingly engaged for axial movement;

said cylindrical member is securable to said shaft to rotate therewith.

50. The invention according to claim 49 in which:

delivery of said fluid into said expansible chamber causes the abutments to be moved simultaneously axially inwardly to operate the mechanical drive means to rotate the propeller blades and to compress the spring means at both ends.

51. The invention according to claim 45 in which:

said abutment connected to said rod is cup-shaped and the bottom of the cup receives said spring means;

said cup-shaped abutment having an annular circumferential flange to which said mechanical drive means are connected;

said abutment connected to said tube has surfaces which receive said spring means and has axial protrusions which position said spring means radially;

said last abutment having an annular circumferential flange to which said mechanical drive means are connected.

52. The invention according to claim 45 in which:

said mechanical drive means includes a pinion gear attached to a base on the inner end of each propeller blade, and a separate drive rack extending axially inwardly from each abutment to each pinion gear, with the rack for each abutment engaging its pinion gear at a location which is diametrically opposite where the rack extending from the other abutment engages the pinion gear.

53. The invention according to claim 52 in which:

the rack and pinion drives are adapted to rotate the propeller blades at least 180 degrees during movement of the two abutments from an axially outer position to an axially inner position where said spring means are compressed at both ends a predetermined amount.

54. The invention according to claim 52 in which:

the spring means bear on the abutments at locations radially inwardly of said racks.

55. The invention according to claim 52 in which:

the hub includes wall means adjacent which said racks extend, and key means extend between said racks and said wall means for bracing and guiding the racks.

56. The invention according to claim 55 in which:

said key means includes an axial groove in a back portion of each rack, a similar axial groove formed in each portion of the wall means that is adjacent a said rack, and an elongated key member which fits partially within one such groove and partially within the other such groove.

57. The invention according to claim 45 including:

fluid operated motor means associated with said hub and a drive shaft for moving the two abutments toward each other to cause operation of the mechanical drive means resulting in a pitch changing rotational force being applied to the propeller blades, and compressing the spring means between them, with venting of the fluid drive means causing the spring means to extend and drive the mechanical drive means and the propeller blades in the opposite direction.

58. An adjustable pitch propeller having a generally hollow hub, a plurality of adjustable pitch propeller blades mounted on said hub, each of said blades having an inner end portion which is located within said hub, and an improved mechanism for varying the pitch of the propeller blades, comprising:

a pair of axially movable abutments spaced axially apart within said hub;

a mechanical drive means interconnected between each abutment and the inner end portion of each blade, each of said mechanical drive means functioning to apply a pitch changing rotational force on its blade in response to an axial movement of its abutment;

compression spring means associated with said abutments to normally bias both of the abutments axially outwardly;

means associated with said hub for applying an axially inward force on said abutments for moving both abutments axially inwardly toward each other in opposition to the force of said spring means to compress the spring means at a plurality of spring ends and to rotate the propeller blades in a first direction, and to store energy in the compressed spring means to rotate the propeller blades in the opposite direction when the axially inwardly directed force is removed from the abutments.

59. The invention according to claim 58 in which:

said mechanical drive means includes a pinion gear attached to a base on the inner end of each propeller blade, and a separate drive rack extending axially inwardly from each abutment to each pinion gear, with the rack for each abutment engaging its pinion gear at a location which is diametrically opposite where the rack extending from the other abutment engages the pinion gear.

60. The invention according to claim 59 in which:

the rack and pinion drives are adapted to rotate the propeller blades at least 180 degrees during movement of the two abutments from an axially outer position to an axially inner position, at which time said spring means are compressed at a plurality of ends a predetermined amount.

61. The invention according to claim 59 in which:

the hub includes wall means adjacent which said racks extend, and key means extend between said racks and said wall means for bracing and guiding the racks.

62. The invention according to claim 61 in which:

said key means includes an axial groove in a back portion of each rack, a similar axial groove formed in each portion of the wall means that is adjacent a said rack, and an elongated key member which fits partially within one such groove and partially within the other such groove.

63. The invention according to claim 58 in which:

said means associated with said hub for applying an axially inward force on said abutments include fluid operated motor means to cause operation of the mechanical drive means resulting in a pitch changing rotational force being applied to the propeller blades, and compressing the spring means, with venting of the fluid drive means causing the spring means to extend and drive the mechanical drive means and the propeller blades in the opposite direction.

64. An adjustable pitch propeller having a generally hollow hub, a plurality of adjustable pitch propeller blades mounted on said hub, each of said blades having an inner end portion which is located within said hub, and an improved mechanism for varying the pitch of the propeller blades, comprising:

a pair of axially moveable abutments spaced axially apart within said hub;

a mechanical drive means interconnected between each abutment and the inner end portion of each blade, each of said mechanical drive means functioning to apply a pitch changing rotational force on its blade in response to axial movement of its abutment; and means associated with said hub for applying an axially inward force on said abutments for moving both abutments axially inwardly toward each other to rotate the propeller blades for pitch variation;

said mechanical drive means including a pinion gear attached to a base on the inner end of each propeller blade, and a separate drive rack extending axially inwardly from each abutment to each pinion gear, with the rack for each abutment engaging its pinion gear at a location which is diametrically opposite where the rack extending from the other abutment engages the pinion gear.

65. The invention according to claim 64 in which:

the rack and pinion drives are adapted to rotate the propeller blades at least 180 degrees during movement of the two abutments from an axially outer position to an axially inner position.

66. The invention according to claim 64 in which:

the hub includes wall means adjacent which said racks extend, and key means extend between said racks and said wall means for bracing and guiding the racks.

67. The invention according to claim 66 in which:

said key means includes an axial groove in a back portion of each rack, a similar axial groove formed in each portion of the wall means that is adjacent a said rack, and an elongated key member which fits partially within one such groove and partially within the other such groove.

68. The invention according to claim 64 in which:

said means associated with said hub for applying an axially inward force on said abutments include fluid operated motor means to cause operation of the mechanical drive means resulting in a pitch changing rotational force being applied to the propeller blades.

* * * * *